US012473805B2

(12) United States Patent
Ejim et al.

(10) Patent No.: US 12,473,805 B2
(45) Date of Patent: Nov. 18, 2025

(54) INVERTED SHROUD FIELD ASSEMBLY FOR GAS ACCUMULATION PREVENTION ABOVE ESPS AND METHOD OF USE

(71) Applicant: SAUDI ARABIAN OIL COMPANY, Dhahran (SA)

(72) Inventors: Chidirim Enoch Ejim, Dhahran (SA); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 78 days.

(21) Appl. No.: 18/487,609

(22) Filed: Oct. 16, 2023

(65) Prior Publication Data

US 2025/0122785 A1 Apr. 17, 2025

(51) Int. Cl.

| | |
|---|---|
| ***E21B 43/12*** | (2006.01) |
| ***E21B 33/12*** | (2006.01) |
| ***F04B 47/06*** | (2006.01) |
| ***F04B 53/16*** | (2006.01) |

(Continued)

(52) U.S. Cl.

CPC ..... *E21B 43/128* (2013.01); *E21B 33/12* (2013.01); *F04B 47/06* (2013.01); *F04B 53/16* (2013.01); *F04B 53/22* (2013.01); *F04D 13/10* (2013.01)

(58) Field of Classification Search

CPC ..... E21B 43/128; E21B 17/04; F04B 47/06; F04D 13/10

See application file for complete search history.

(56) References Cited

U.S. PATENT DOCUMENTS

| | | | | |
|---|---|---|---|---|
| 7,766,081 | B2 | 8/2010 | Brown et al. | |
| 8,291,983 | B2 * | 10/2012 | Rooks | E21B 43/128 166/107 |
| 9,638,015 | B2 * | 5/2017 | Nowitzki | F04D 29/628 |

(Continued)

FOREIGN PATENT DOCUMENTS

| | | | |
|---|---|---|---|
| CA | 2911955 | C | 10/2017 |
| CN | 201521432 | U | 7/2010 |

(Continued)

OTHER PUBLICATIONS

International Search Report issued for corresponding international patent application No. PCT/US2024/050415, mailed Jan. 27, 2025 (6 pages).

(Continued)

*Primary Examiner* — Catherine Loikith

(74) *Attorney, Agent, or Firm* — Osha Bergman Watanabe & Burton LLP

(57) ABSTRACT

A method includes providing an electrical submersible pump assembly with a pump, an intake, shroud base flanges, a protector, and a motor. The method includes coupling the shroud base flanges to an intake downhole end using fasteners and a set of protector top bolt holes. The method includes locating a closed end of an inverted shroud between the intake and the protector. The inverted shroud includes a shroud base on the closed end, and an opposite open end that is open toward the packer. The method includes coupling the inverted shroud to the shroud base flanges. The packer is located uphole of the opposite open end at a distance causing a mixing of a gas pocket with the well fluid to form a combined gas and liquid mixture and directing the combined gas and liquid mixture in a direction toward the intake.

10 Claims, 12 Drawing Sheets

(51) Int. Cl.
*F04B 53/22* (2006.01)
*F04D 13/10* (2006.01)

(56) References Cited

U.S. PATENT DOCUMENTS

| | | | | |
|---|---|---|---|---|
| 10,119,383 | B2 | 11/2018 | Mazzanti | |
| 10,378,322 | B2 | 8/2019 | Ejim et al. | |
| 11,149,535 | B2 | 10/2021 | Brown et al. | |
| 11,408,427 | B2 | 8/2022 | Webster et al. | |
| 2010/0122818 | A1* | 5/2010 | Rooks | E21B 43/128 166/104 |
| 2013/0068455 | A1 | 3/2013 | Brown et al. | |
| 2018/0274344 | A1 | 9/2018 | Ejim et al. | |
| 2024/0287882 | A1 | 8/2024 | Alghamdi | |

FOREIGN PATENT DOCUMENTS

| | | | |
|---|---|---|---|
| CN | 208830968 | U | 5/2019 |
| WO | 9708459 | A1 | 3/1997 |
| WO | 2010056648 | A1 | 5/2010 |
| WO | 2016123162 | A1 | 8/2016 |
| WO | 2019032764 | A1 | 2/2019 |

OTHER PUBLICATIONS

Written Opinion issued for corresponding international patent application No. PCT/US2024/050415, mailed Jan. 27, 2025 (8 pages).

Bridges et al., "ESP Recirculation System in Artificial Sump," Society of Petroleum Engineers International, SPE-171366-MS, Oct. 6, 2014, 8 pages.

Gonzalez et al., "Improving Gas Separation in ESP for Unconventional Wells in 5-1/2" Casing. Case Studies in the Permian Basin, Society of Petroleum Engineers International, SPE-194418-MS, May 6, 2019, 23 pages.

* cited by examiner

INVERTED SHROUD FIELD ASSEMBLY FOR GAS ACCUMULATION PREVENTION ABOVE ESPS AND METHOD OF USE

BACKGROUND

The disclosure relates generally to production of fluid from subterranean reservoirs. More particularly, the disclosure relates to the use of electrical submersible pump assemblies that reduce gas accumulation of the fluid intakes.

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water. Typically, a production tubing is disposed in the wellbore to carry the fluids to the surface. In some formations, pressure within the rock formation causes the resources to flow naturally from the formation to the surface. One common challenge in producing fluids from a hydrocarbon reservoir through a wellbore is that, in some formations, the pressure in the formation is not adequate to cause the flow against gravity out of the formation to the surface or is not adequate to cause the flow to meet flowrate goals. In such instances, artificial lift technology can be used to add energy to fluid to bring the resources to the surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a method that includes providing an electrical submersible pump assembly (ESP) with a pump, an intake, shroud base flanges, a protector, and a motor. The method includes providing fluid communication between a production tubing and the ESP. The production tubing delivers well fluid containing both gases and liquids from the ESP into a wellhead assembly through an inner bore of the production tubing. The method includes circumscribing the production tubing with a packer assembly downstream of the ESP, then coupling the shroud base flanges to a top surface of an intake base flange. The shroud base flanges are disposed on an intake downhole end of the intake. The shroud base flanges are disposed using a first set of fasteners, a set of inner bolt holes disposed on the shroud base flanges, and a set of protector top bolt holes disposed on a protector top surface of a protector top flange of the protector. The method includes locating a closed end of an inverted shroud between the intake and the protector. The inverted shroud includes a shroud base disposed on the closed end, and an opposite open end that is open toward the packer assembly. The method includes coupling the inverted shroud to the shroud base flanges using a second set of fasteners, a set of outer bolt holes disposed on the shroud base flanges, and a set of shroud base bolt holes disposed on the shroud base. The packer assembly is located uphole of the opposite open end at a distance causing a mixing of a gas pocket with the well fluid to form a combined gas and liquid mixture and directing the combined gas and liquid mixture in a direction toward the intake.

This disclosure presents, in accordance with one or more embodiments, a method that includes providing an electrical submersible pump assembly (ESP) with a pump, an intake that includes an extended intake base flange, a protector, and a motor. The method includes providing fluid communication between a production tubing and the ESP. The production tubing delivers well fluid containing both gases and liquids from the ESP into a wellhead assembly through an inner bore of the production tubing. The method includes circumscribing the production tubing with a packer assembly downstream of the ESP, then locating a closed end of an inverted shroud between the intake and the protector. The inverted shroud includes a shroud base disposed on the closed end, and an opposite open end that is open toward the packer assembly. The method includes coupling the inverted shroud to the extended intake base flange using a set of fasteners, a set of outer bolt holes disposed on the extended intake base flange, and a set of shroud base bolt holes disposed on the shroud base. The packer assembly is located uphole of the opposite open end at a distance causing a mixing of a gas pocket with the well fluid to form a combined gas and liquid mixture and directing the combined gas and liquid mixture in a direction toward the intake.

This disclosure presents, in accordance with one or more embodiments, a method that includes providing an electrical submersible pump assembly (ESP) with a pump, an intake with an integrated shroud base flange, a protector, and a motor. The method includes providing fluid communication between a production tubing and the ESP. The production tubing delivers well fluid containing both gases and liquids from the ESP into a wellhead assembly through an inner bore of the production tubing. The method includes circumscribing the production tubing with a packer assembly downstream of the ESP, then locating an inverted shroud between the intake and the protector. The inverted shroud includes a first set of bolt holes on an inverted shroud downhole end, and an opposite open end that is open toward the packer assembly. The method includes coupling, using a set of fasteners, the first set of bolt holes, and a second set of bolt holes disposed on the integrated shroud base flange, the inverted shroud to the integrated shroud base flange. The packer assembly is located uphole of the opposite open end at a distance causing a mixing of a gas pocket with the well fluid to form a combined gas and liquid mixture and directing the combined gas and liquid mixture in a direction toward the intake.

This disclosure presents, in accordance with one or more embodiments, a system that includes an electrical submersible pump assembly (ESP) with a pump, an intake, shroud base flanges, a protector, and a motor. The system includes production tubing in fluid communication with the ESP with an inner bore sized to deliver well fluid containing both gases and liquids from the ESP to a wellhead assembly. The system includes a packer assembly circumscribing the production tubing downstream of the ESP. The system includes a first set of fasteners, a set of inner bolt holes disposed on the shroud base flanges, and a set of protector top bolt holes disposed on a protector top surface of a protector top flange of the protector. The first set of fasteners is configured to couple the shroud base flanges to a top surface of an intake base flange disposed on an intake downhole end of the intake. The system includes an inverted shroud with a closed end configured to be located between the intake and the protector, an opposite open end that is open towards the packer assembly, and a shroud base disposed on the closed end. The system includes a second set of fasteners configured to couple the inverted shroud to the shroud base flanges using a set of outer bolt holes disposed on the shroud base flanges and a set of base bolt holes disposed on the shroud base. The packer assembly is located uphole of the opposite open end at a distance operable to cause a mixing of a gas pocket with the well fluid to form a combined gas and liquid mixture and to direct the combined gas and liquid mixture in a direction towards the intake.

This disclosure presents, in accordance with one or more embodiments, a system that includes an electrical submersible pump assembly (ESP) with a pump, an intake with an extended intake base flange, a protector, and a motor. The system includes production tubing in fluid communication with the ESP with an inner bore sized to deliver well fluid containing both gases and liquids from the ESP to a wellhead assembly. The system includes a packer assembly circumscribing the production tubing downstream of the ESP. The system includes an inverted shroud with a closed end configured to be located between the intake and the protector, an opposite open end that is open towards the packer assembly, and a shroud base disposed on the closed end. The system includes a set of fasteners configured to couple the inverted shroud to the extended intake base flange using a set of outer bolt holes disposed on the extended intake base flange and a set of base bolt holes disposed on the shroud base. The packer assembly is located uphole of the opposite open end at a distance operable to cause a mixing of a gas pocket with the well fluid to form a combined gas and liquid mixture and to direct the combined gas and liquid mixture in a direction towards the intake.

This disclosure presents, in accordance with one or more embodiments, a system that includes an electrical submersible pump assembly (ESP) with a pump, an intake with an integrated shroud base flange, a protector, and a motor. The system includes production tubing in fluid communication with the ESP with an inner bore sized to deliver well fluid containing both gases and liquids from the ESP to a wellhead assembly. The system includes a packer assembly circumscribing the production tubing downstream of the ESP. The system includes an inverted shroud with a first set of bolt holes on an inverted shroud downhole end and an opposite open end that is open towards the packer assembly. The system includes a set of fasteners configured to couple the inverted shroud to the integrated shroud base flange using the first set of bolt holes and a second set of bolt holes disposed on the integrated shroud base flange. The packer assembly is located uphole of the opposite open end at a distance operable to cause a mixing of a gas pocket with the well fluid to form a combined gas and liquid mixture and to direct the combined gas and liquid mixture in a direction towards the intake.

Other aspects and advantages of the claimed subject matter will be apparent from the following description and the appended claims.

BRIEF DESCRIPTION OF DRAWINGS

FIG. 4*a* shows an enlarged view of a portion of FIG. 4A in accordance with one or more embodiments.

DETAILED DESCRIPTION

Figure 1:
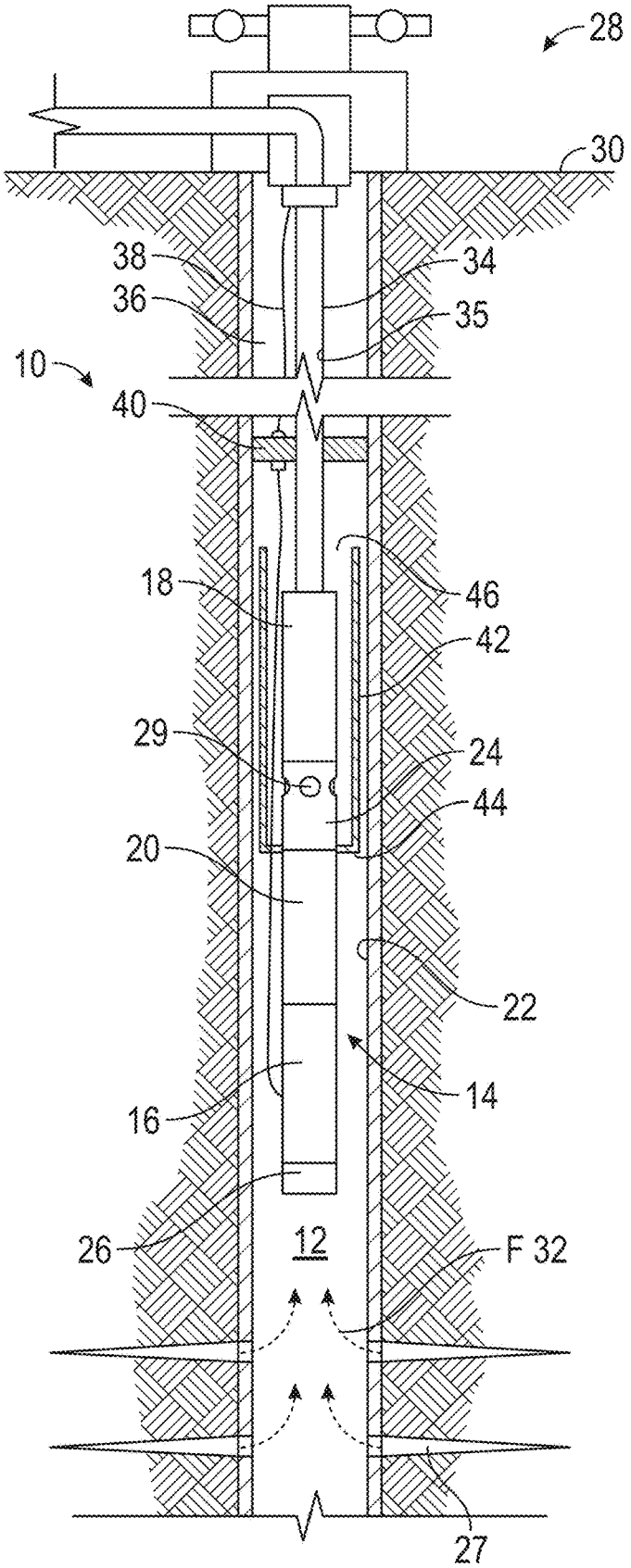
FIG. 1 shows a section view of a subterranean well having an electrical submersible pump assembly, in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

For bringing liquids out of a subterranean wellbore to the surface of the Earth, various techniques such as artificial lift technology may be used. Artificial lift technology may include, for example, a pump and associated components to assist in lifting the fluids up the wellbore. As an example, production tubing associated with the wellbore may include one or more pumps to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems.

Notably, ESP performance may be impacted by various reservoir characteristics such as, for example, gas-oil ratio, water cut, flowing wellhead pressure (FWHP), well test liquid rate, and pump operating frequency. It is beneficial to be able to adjust parameters to optimize ESP performance. In particular, there exists a need for a method for optimizing the performance of ESPs in real time by recommending the optimum pump control settings to maximize pump operating efficiency and minimize overall power consumption for a determined target well rate.

As such, embodiments disclosed herein present systems and methods that may enable producing a well, reduce the gaseous component of a combined gas and liquid mixture produced from the well, and improve installation of an ESP inverted shroud onto an ESP assembly disposed in the well. The shroud is installed at a wellsite by field personnel. Embodiments disclosed herein may facilitate installation by field personnel with minimal deviation from standard installation procedure. One of the challenges of the installation procedure for the ESP shroud is the attachment of the shroud to an existing ESP with minimal modification to current ESP architecture. A second challenge is the assembly at the wellsite of the relatively long length of the inverted shroud. Embodiments disclosed herein propose a method and a system to resolve these challenges with minimal modifications to the standard installation procedure and to the ESP architecture.

FIG. 1 shows a system for producing hydrocarbons from subterranean well 10. Subterranean well 10 includes wellbore 12. Electrical submersible pump assembly (e.g. an ESP 14) is located within wellbore 12. Wellbore 12 can include outer tubular member 22, which can be, for example, a well casing or other large diameter well tubing. ESP 14 includes a motor 16 at or near the lowermost end of ESP 14. Motor 16 is used to drive a pump 18 at an upper portion of ESP 14. Between motor 16 and pump 18 is protector 20 and intake 24. Protector 20 can be used for equalizing pressure within ESP 14 with that of wellbore 12, for providing a seal between intake 24 and motor 16, for containing an oil reservoir for motor 16, and for helping to convey the thrust load of the pump 18.

A monitoring sub such as sensor 26 may be included in ESP 14 as an optional element. In the example embodiment of FIG. 1, sensor 26 is located at a lower end of motor 16. Sensor 26 can gather and provide data relating to operations of ESP 14 and conditions within wellbore 12. As an example, sensor 26 can monitor and report the intake pressure and temperature and the discharge pressure and temperature of the pump 18. The sensor may monitor and report the lubricating oil and winding temperatures of the motor 16, the assembly vibration of ESP 14 in multiple axes, and any leakage current of motor 16 of ESP 14.

In accordance with one or more embodiments, pump 18 is adjacent to intake 24, intake 24 is located between pump 18 and protector 20, protector 20 is located between intake 24 and motor 16, and motor 16 is located further within subterranean well 10 than pump 18. Therefore, from top to bottom the elements are ordered: pump 18, intake 24, protector 20, and motor 16.

Well fluid such as well fluid F (e.g., a well fluid 32) is shown entering wellbore 12 from a formation adjacent to the wellbore 12 through perforations 27. Well fluid F for production, flows to opening 29 of intake 24. The cross sectional area through which well fluid F travels from perforations 27 to intake 24 is not reduced to a small diameter bore, thus offering an advantage over other systems such as those that utilize, for example, stingers upstream of intake 24. The lack of reduction of the bore therefore causes no significant increase in the velocity of well fluid F, no significant decrease in the pressure of well fluid F, and reduces the potential for gas breakout versus systems that utilize the stingers upstream of intake 24.

Well fluid F is pressurized by pump 18 and travels up to wellhead assembly 28 at surface 30 through a production tubing 34. Production tubing 34 is in fluid communication with ESP 14. The production tubing has an inner bore (e.g., an inner bore 35) sized to deliver well fluid F from ESP 14 to wellhead assembly 28. ESP 14 is positioned within wellbore 12 so that motor 16 is located downstream, or uphole, of perforations 27 through the outer tubular member 22 so that well fluid F flowing through perforations 27 pass the motor 16 before entering intake 24. This helps to cool motor 16 with well fluid F.

ESP 14 is suspended from, and supported by, production tubing 34. Production tubing 34 is an elongated tubular member that extends within subterranean well 10. Production tubing 34 can be formed of carbon steel material, carbon fiber tube, or other types of corrosion resistance alloys or coatings.

Well fluid F may contain both gases and liquids as it enters intake 24 and both the gases and liquids can be produced to wellhead assembly 28 through production tubing 34 as a combined production fluid. Pump 18 is operable to provide artificial lift to well fluid F that contain a combined gas and liquid mixture and production tubing 34 has an inner bore sized to deliver the combined gas and liquid mixture to wellhead assembly 28.

Well fluid F is produced through production tubing 34. There is no outlet for well fluid within ESP 14 to travel back into wellbore 12, i.e., well fluid F are not produced through the tubing casing annulus 36. Tubing casing annulus 36 is an annular space located between an outer diameter of production tubing 34 and an inner diameter of outer tubular member 22.

Power cable 38 extends through wellbore 12 alongside production tubing 34. Power cable 38 can provide the power required to operate motor 16 of ESP 14. Power cable 38 extends to a packer assembly (e.g., a packer 40) and can be connected to packer with a packer penetrator at the top side of packer. Power cable 38 can then extend between packer and motor 16 with a motor lead extension. The motor lead extension can be connected to a packer penetrator at the bottom side of packer. Power cable 38 can be a suitable power cable for powering an ESP 14, known to those with skill in the art.

Figure 2:
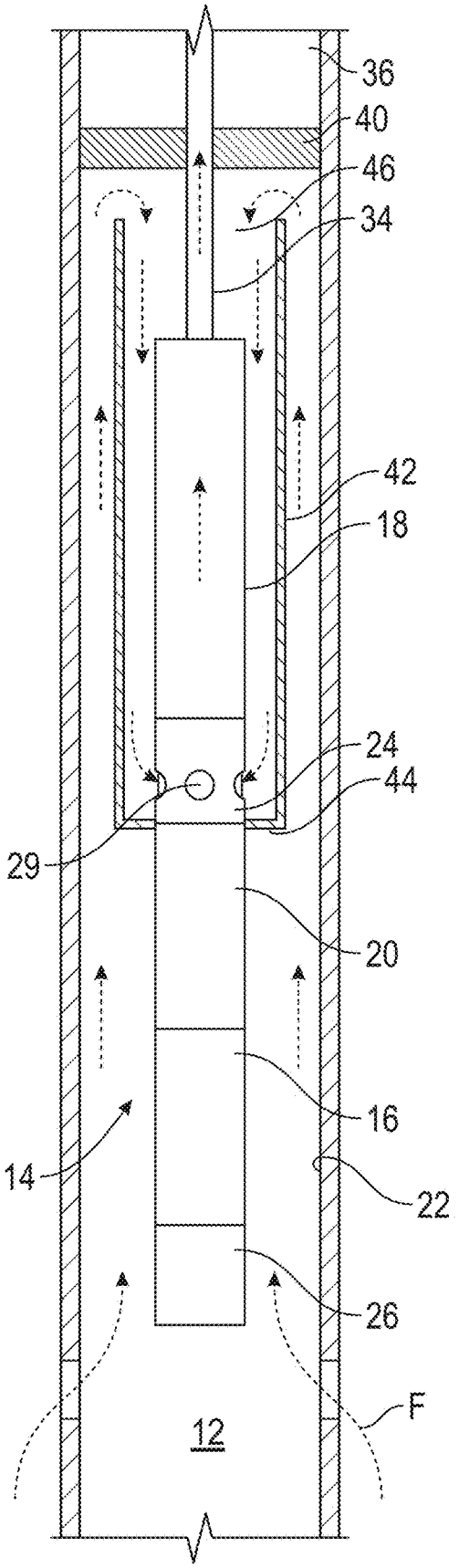
FIG. 2 shows a section view of an electrical submersible pump assembly, in accordance with one or more embodiments.

FIG. 2 shows that the packer circumscribes production tubing 34 downstream of ESP 14. Packer can be in a contracted position when lowering the packer into wellbore 12. In the contracted position, an outer diameter of packer assembly is spaced apart from the inner diameter of outer tubular member 22. Packer is moveable to an expanded position so that the outer diameter of packer is in sealing engagement with the inner diameter of outer tubular member 22. A sealing element of packer can be a traditional packer member known in the art and set in a typical way. Power cable 38 can then extend between packer and motor 16. Packer is retrievable with ESP 14. As ESP 14 is pulled out of subterranean well 10 with production tubing 34, packer will remain secured to ESP 14. Packer can be designed to contain the pressures of wellbore 12 so that packer is a high pressure mechanical barrier.

Inverted shroud 42 is a generally tubular member that has closed end 44 located between intake 24 and protector 20. Closed end 44 circumscribes ESP 14 and prevents well fluid F from entering within inverted shroud 42 at closed end 44. An opposite open end (e.g., an open end 46) of inverted shroud 42 is open towards the packer assembly. Fluids flowing through perforations 27 therefore travel in a direction towards wellhead assembly 28 (FIG. 1). Due to the presence of inverted shroud 42, well fluid F continues upwards past the motor 16 towards packer. Well fluid F then changes direction and travels away from the wellhead assembly 28 before entering the intake 24 and being produced through production tubing 34 to wellhead assembly 28.

Well fluid F flowing up the wellbore 12 is therefore made to go through a 180° turn towards intake 24. Due to this turn and the interaction and mixing of well fluid F at and below a bottom surface of packer, any gas pockets keep moving with well fluid F and accumulation of gas under the packer is prevented. If any gases do separate from liquid and begin to gather at the bottom surface of packer, eddies and current of well fluid F will cause such gases to be carried with well fluid F into intake 24. Therefore, the bottom of packer remains free of accumulated gas. The liquid and gas components of well fluid F are well mixed, therefore the liquid phase carries the gas pockets into the intake 24 and pump 18 pressurizes and pumps the combined gas and liquid mixture to the surface as in a conventional method.

Packer is spaced apart from inverted shroud 42 a distance that provides for a mixing of the gases and liquids of well fluid F. Mixing of the combined gas and liquid mixture occurs between packer and inverted shroud 42 before the combined gas and liquid mixture enters the inverted shroud 42. As an example, the open end of inverted shroud 42 can be spaced from packer to allow mixing of the gas and liquid in the well fluid mixture. In an alternate example, the open end of inverted shroud 42 can be spaced a distance from packer to allow mixing of the gas and liquid well fluid.

In an example of operation, production tubing 34 can support ESP 14 and be used to lower ESP 14 into wellbore 12. ESP 14 can be lowered into subterranean well 10 to a final position where motor 16 is downstream of perforations 27 (FIG. 1) through outer tubular member 22. Packer can be moved in a traditional manner to an expanded position so that an outer diameter of packer is in sealing engagement with an inner diameter of outer tubular member 22.

Fluids flowing through perforations 27 travel in a direction towards wellhead assembly 28, continue upwards past the motor towards packer, and go through a 180° turn into the open end of inverted shroud 42 towards intake 24. Gas keeps moving with well fluid F and pump 18 pressurizes and pumps the combined gas and liquid mixture to the surface as in a conventional method. If ESP 14 has to be pulled out for any reason, ESP 14 can be retrieved safely with production tubing 34.

Therefore, as disclosed herein, embodiments of the systems and methods of this disclosure will prevent the accumulation of gas at a bottom side of packer. The free gas is instead kept mixed with the liquid components of well fluid F, reducing the degradation of electrical and mechanical components in the region of packer, and increasing the reliability of ESP 14. Systems and methods of this disclosure can be utilized with currently available ESP components and can reduce the overall life cycle costs of the ESP and prevent deferred production costs.

Figure 3:
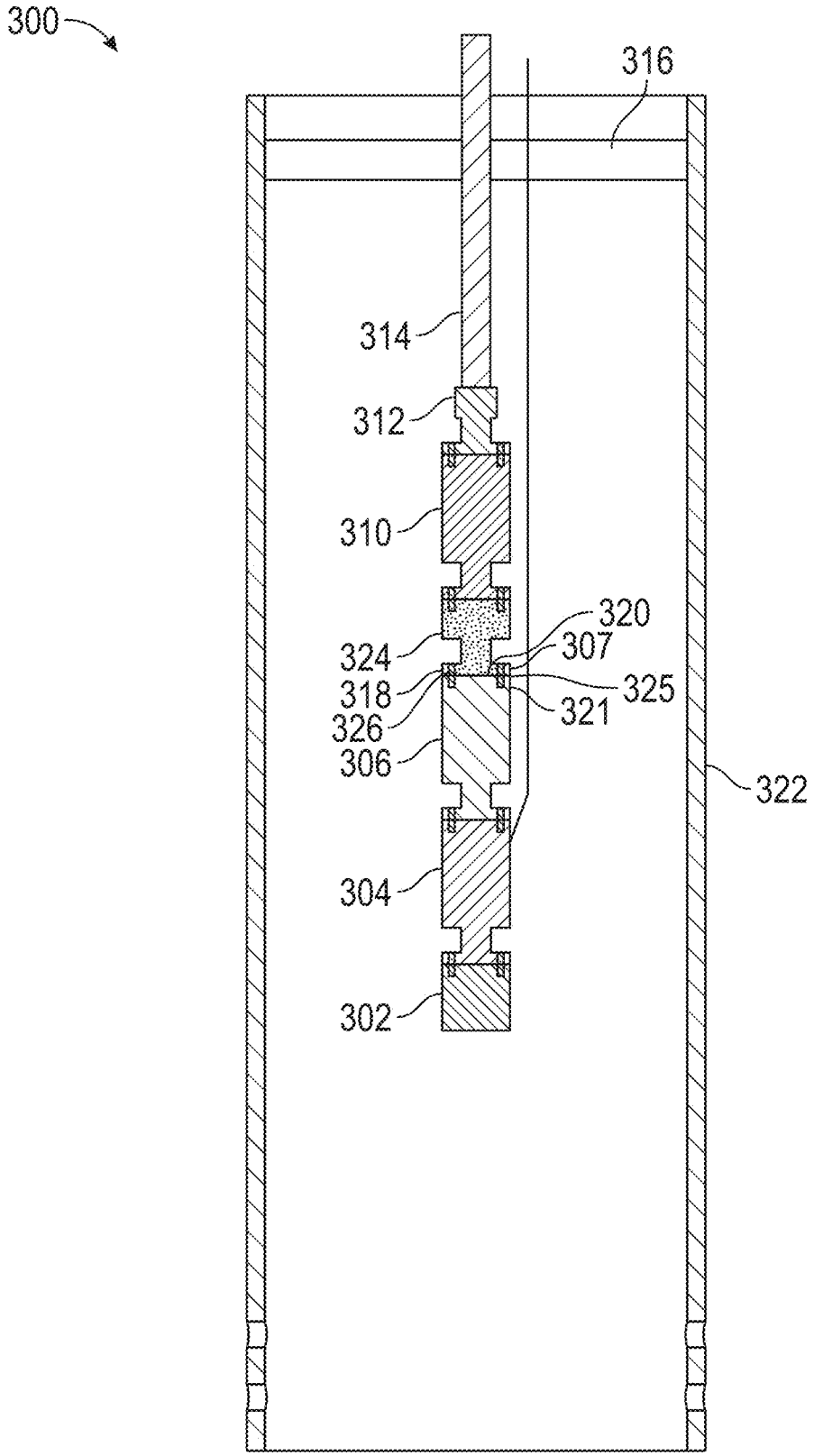
FIG. 3 shows a conventional configuration of a tubing-deployed ESP in accordance with one or more embodiments.

FIG. 3 shows the conventional configuration of a tubing-deployed ESP (e.g., tubing-deployed ESP 300). In typical field installations, the monitoring sub or downhole gauge, e.g., sub 302) is coupled to a motor (e.g., motor 304) via a flanged connection. This combined sub-assembly (e.g., the sub and the motor) is first lowered in a well (e.g., well 10, FIG. 1) before the bottom portion of a protector (e.g., protector 306) is coupled to the top part (uphole end) of the motor via another flanged connection. The three connected components (e.g. the sub, the motor, and the protector) are lowered in the well. A downhole end (e.g., an intake downhole end 307) of a pump intake 324 has an intake base flange (e.g., an intake base flange 318). The intake base flange is connected to an uphole end of the protector (e.g., a protector top surface 320) at a protector top flange (e.g., a protector top flange 321). The coupling of the protector top flange to the intake base flange forms an intake-protector interface (e.g., an intake-protector interface 325). Coupling the flanges may use fasteners (e.g., fasteners 326) as known in the art.

The coupling method is repeated for the installation of a pump (e.g., a pump 310) and a discharge head 312. The production tubing (e.g., pipe element 314) is typically threaded into the discharge head and entire downhole assembly is lowered into the well in step-wise manner as additional production tubing is connected by field personnel on the rig floor. Once the entire downhole assembly reaches the desired setting depth, a packer assembly (e.g., a packer 316) is set to contact the inner walls of the casing (e.g., outer tubular member 322), thereby providing the required isolation in the well prior to commencing production.

Inverted Shroud Coupling Systems

Split Flange System

Figure 4A:
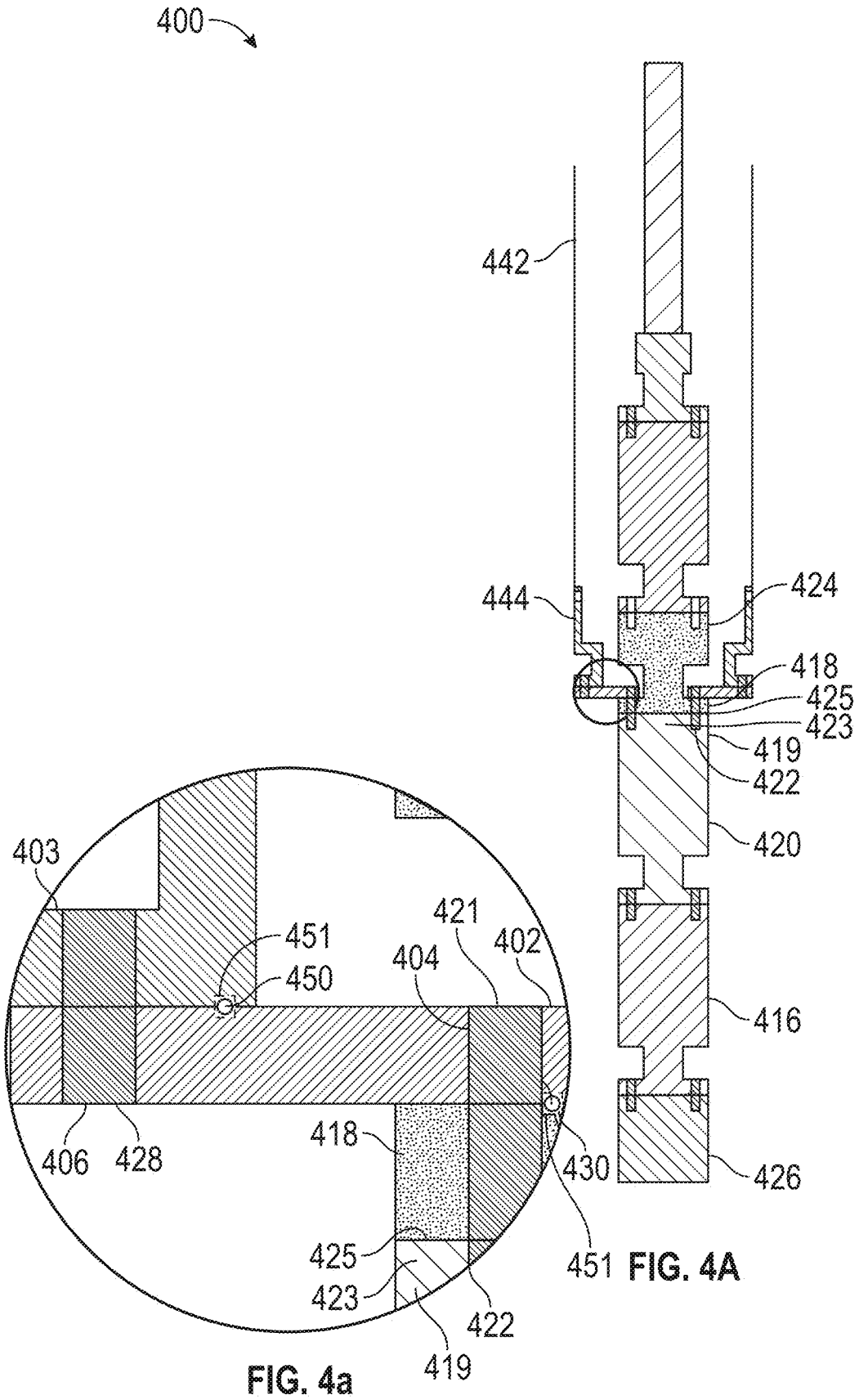
FIG. 4A shows an inverted shroud coupled using shroud base flanges in accordance with one or more embodiments.

FIG. 4A shows an embodiment of the proposed improvement to the coupling of the shroud to the ESP. FIG. 4*a* shows an enlarged view of a portion of FIG. 4A. To install the inverted shroud, one objective is to have minimal change to existing ESP architecture from the ESP manufacturer. The first task is to attach the sub assembly to the existing ESP.

The system (e.g., split flange system 400) in FIG. 4A shows use of a set of split flanges to couple the inverted shroud module to the ESP. FIG. 4A shows the intake base flange (e.g., intake base flange 418) below the pump intake (e.g., intake 424) disposed as is customary at the protector top surface (e.g., protector top surface 423) connection to the protector top flange (e.g., protector top flange 419). The protector top flange comprises a set of protector top bolt holes (e.g., protector top bolt holes 422). FIG. 4A shows that the inverted shroud (e.g., inverted shroud 442) is coupled to the intake-protector interface (e.g., intake-protector interface 425) using the shroud base flanges such as a set of split flanges that adapt the inverted shroud to the intake-protector interface.

Figure 4B:
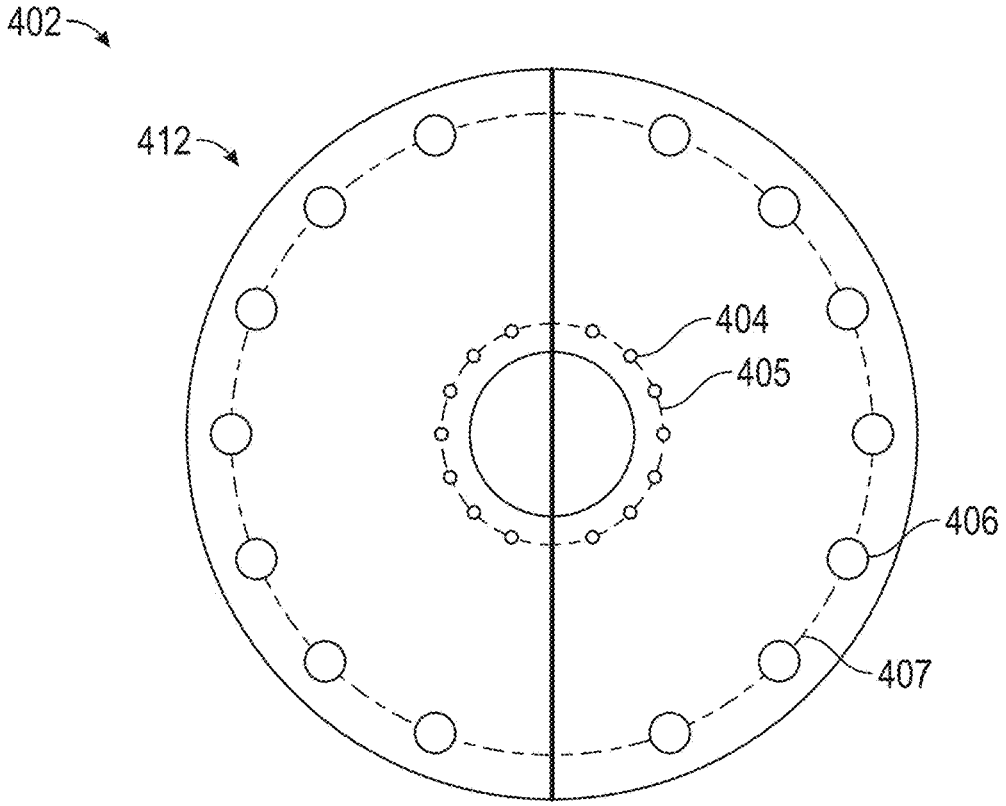
FIG. 4B shows an example of the shroud base flanges with one split in accordance with one or more embodiments.
Figure 4C:
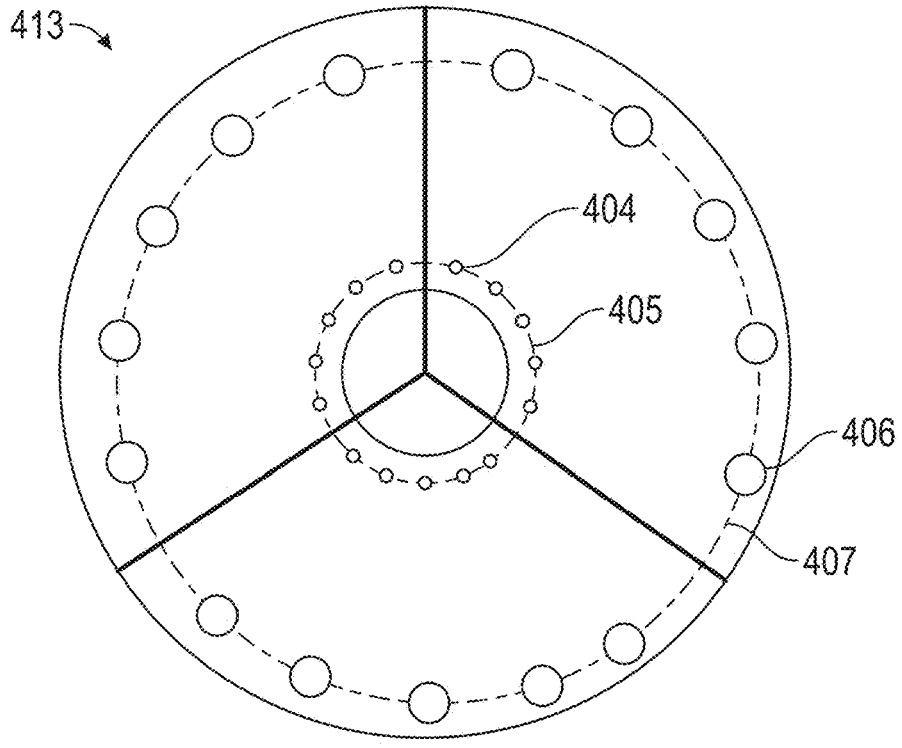
FIG. 4C shows an example of the shroud base flanges with three splits in accordance with one or more embodiments.

The split flanges may be split into two pieces, three pieces, or any practical number of pieces. Hereafter the split flanges are termed shroud base flanges, (e.g., shroud base flanges 402) FIG. 4B shows an example of the shroud base flanges with one split across the flange outer circumference to form two pieces (e.g., two-piece flanges 412). FIG. 4C shows a set of the shroud base flanges with three splits. Each of the three splits is made from the flange outer circumference to the flange center to form three pieces (e.g., three-piece flanges 413).

The shroud base flanges are configured with a set of inner bolt holes (e.g., inner holes 404) on an inner bolt circle (e.g., inner bolt circle 405). The inner bolt holes are configured to connect the shroud base flanges to the intake-protector interface using fasteners (e.g., first set of fasteners 421).

Installation includes connecting the shroud base to the shroud base flanges. Fasteners disposed through the outer bolt holes couple the shroud base to the shroud base flanges. The shroud base flanges are also configured with a set of outer bolt holes (e.g., outer holes 406) on an outer bolt circle (e.g., outer bolt circle 407). The outer bolt holes are configured to connect the shroud base flanges to an inverted shroud base (e.g., a shroud base 444) using fasteners (e.g., a second set of fasteners 428) and a set of shroud base bolt holes (e.g., shroud base holes 403).

Installation of the inverted shroud may occur after the downhole gauge (e.g., sensor 426), motor (e.g., motor 416), and protector (e.g., protector 420) have been connected. Installation includes placing the intake 424 (e.g., intake 424) over the protector and bolting the shroud base flanges onto a top surface (e.g., intake base flange top surface 430) of the intake base flange via the inner bolt holes. Fasteners disposed through the inner bolt holes couple the shroud base flanges and the intake base to the top of the protector.

Installation includes connecting the inverted shroud to the shroud base, and/or the inverted shroud directly to the shroud base flanges. In accordance with one or more embodiments coupling techniques are disclosed including the use of fasteners, friction, hook and groove, and threads.

Fasteners with split flanges. An inverted shroud downhole end may have a set of bolt holes (e.g., shroud bolt holes). The shroud bolt holes may correspond to and cooperate with a set of bolt holes (e.g., the outer holes) on the shroud base flanges or the shroud bolt holes (e.g., shroud bolt holes) may correspond to and cooperate with a set of base shroud holes (e.g., base shroud holes). The inverted shroud may couple to the shroud base using a set of fasteners, the shroud bolt holes, and the base shroud holes. The inverted shroud may couple directly to the shroud base flanges using a set of fasteners, the shroud bolt holes on the inverted shroud downhole end, and the outer holes on the shroud base flanges.

Friction with split flanges. Friction elements or a single friction element disposed in the inverted shroud may couple the shroud to the shroud base and/or to the shroud base flanges. An inverted shroud downhole end may have an exterior profile with a friction element such as an o-ring (e.g., a friction element) and a friction element groove such as an o-ring groove (e.g., a groove). The groove is configured for the o-ring. The friction element may correspond to and cooperate with an interior profile with a friction element preparation on the shroud base. The inverted shroud may couple to the shroud base using the exterior profile, the friction element, the groove, the interior profile, and the friction element preparation. The friction element may correspond to and cooperate with an interior profile with a friction element preparation on the shroud base flanges. The inverted shroud may couple directly to the shroud base flanges using the exterior profile, the friction element, the groove, the interior profile, and the friction element preparation.

Hook and groove with split flanges. A J-hook disposed in the inverted shroud may couple the shroud to the shroud base and/or to the shroud base flanges. An inverted shroud downhole end may have an exterior profile with a J-hook element (e.g., a hook). The hook may correspond to and cooperate with an interior profile with a J-slot-and-groove, i.e., a slot element (e.g., a slot) on the shroud base. The inverted shroud may couple to the shroud base using the exterior profile, the J-hook element, the interior profile, and the slot element. The hook may correspond to and cooperate with an interior profile with a J-slot-and-groove, i.e., a slot element (e.g., a slot) on the shroud base flanges. The inverted shroud may couple directly to the shroud base flanges using the exterior profile, the J-hook element, the interior profile, and the slot element.

Threads with split flanges. A thread disposed in the inverted shroud may couple the shroud to the integrated flange. An inverted shroud downhole end may have an exterior profile with a first thread element such as a male thread (e.g., a pin). The pin may correspond to and cooperate with an interior profile comprising a second thread element such as a female thread (e.g., a box) on the shroud base. The inverted shroud may couple to the shroud base using the exterior profile, the first thread, the interior profile, and the second thread element. The pin may correspond to and cooperate with an interior profile comprising a second thread element such as a female thread (e.g., a box) on the shroud base flanges. The inverted shroud may couple to the shroud base flanges using the exterior profile, the first thread element, the interior profile, and the second thread element.

External connections mainly facilitate fastening of the inverted shroud to the ESP. Substantially most fluid will not go through non-gastight gaps. Substantially most of the fluid preferentially flows in an uphole direction and then makes a U-turn thereby flowing in a downhole direction into the intake.

The inverted shroud system may include sealing (e.g., seal 450) to prevent passage of liquids and/or gases across the inverted shroud components. For example, sealing may be provided in the shroud base flanges and intake connection area with minimal modification to the intake. This may be achieved by including a gasket (e.g., seal 450) between the shroud base flanges and top surface of the intake base, which can all be bolted down to the protector. This forms a shroud-flange seal between the inverted shroud and the intake. The shroud base flanges and the top surface of the intake base may comprise o-ring grooves (e.g., o-ring groove 451) configured for use with an O-ring to provide sealing.

Likewise, sealing may be provided between the shroud base and the top surface of the shroud base flanges. For example, a gasket (e.g., seal 450) may be placed between the shroud base and the shroud base flanges with the fasteners through the outer bolt holes coupling the gasket between the shroud base and the shroud base flanges. This forms a shroud base-top surface seal between the inverted shroud and the intake. In another embodiment, the shroud base flanges and/or shroud base connection profiles may include a groove (e.g., o-ring groove 451) configured for use with an O-ring (e.g., seal 450) to provide sealing.

Extended Flange System

Figures 5, 5A:
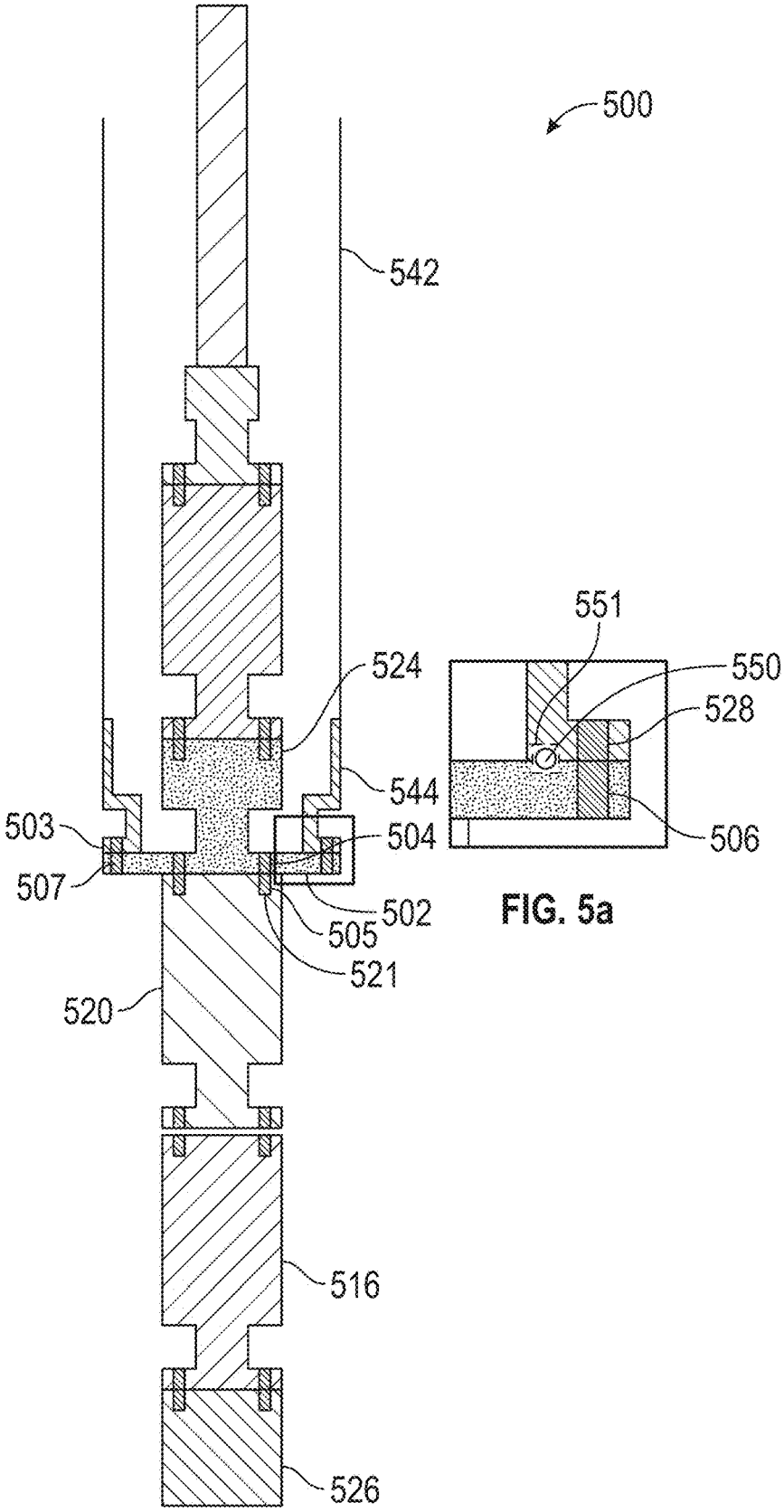
FIG. 5 shows the inverted shroud coupled using an extended intake base flange in accordance with one or more embodiments.
FIG. 5*a* shows an enlarged view of a portion of FIG. 5 in accordance with one or more embodiments.
Figures 6, 6A:
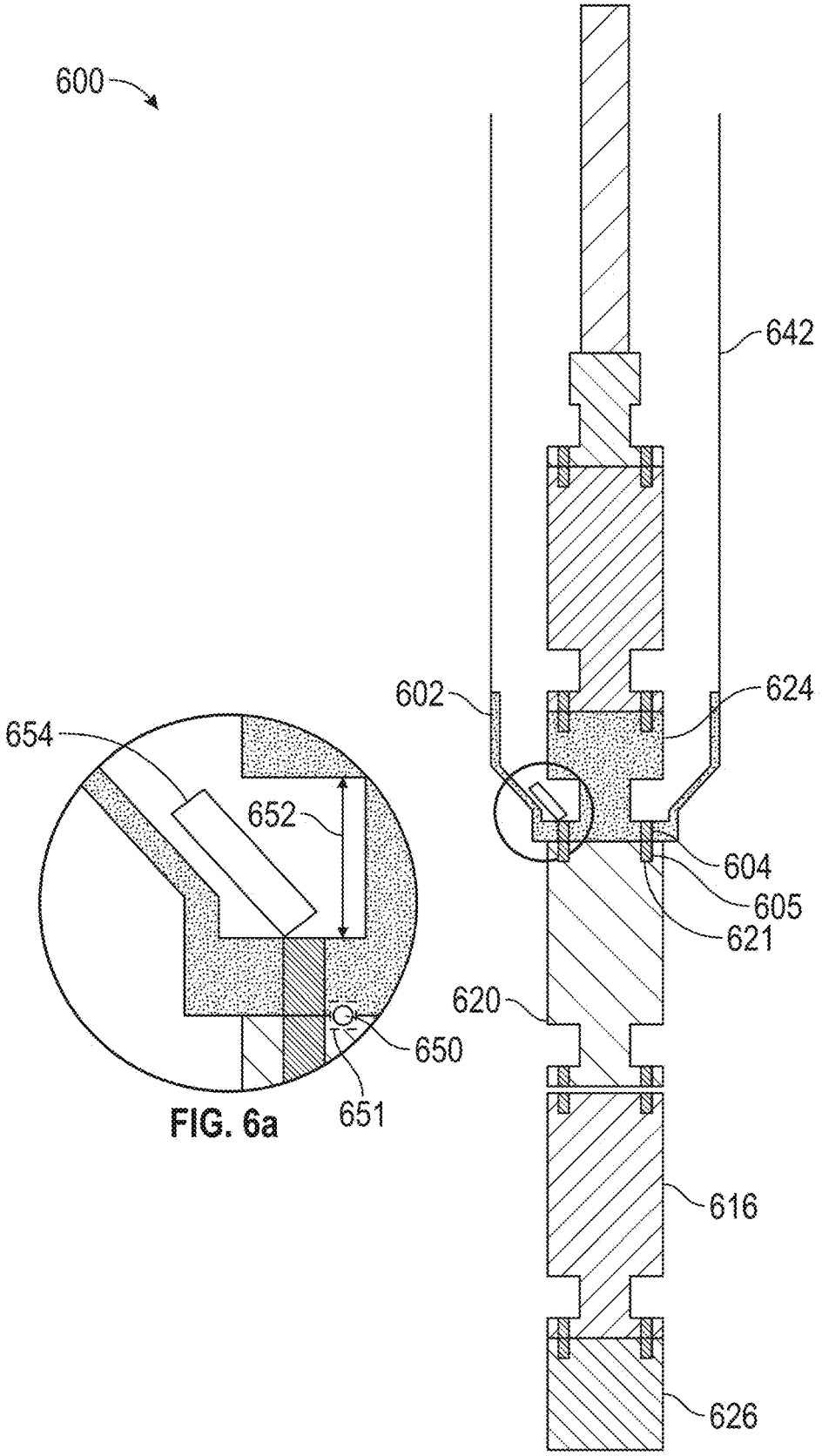
FIG. 6 shows the inverted shroud coupled using an integrated shroud-intake base in accordance with one or more embodiments.
FIG. 6*a* shows an enlarged view of a portion of FIG. 6 in accordance with one or more embodiments.

FIGS. 5 and 6 show embodiments in which accommodations for the inverted shroud are implemented on the intake. The system (e.g., extended flange system 500) in FIG. 5 shows use of an extended intake base flange (e.g., extended intake base flange 502) to couple the inverted shroud module (e.g., inverted shroud 542). FIG. 5*a* shows an enlarged view of a portion of FIG. 5. FIG. 5 shows the intake base flange has been extended radially i.e., the intake base flange outside diameter has been increased, to form an extended intake base flange. The extended intake base flange is configured to couple to the shroud base.

The extended flange is configured with a set of inner bolt holes (e.g., inner holes 504) on an inner bolt circle (e.g., inner bolt circle 505). The inner bolt holes are configured to connect the intake to the protector forming the intake-protector interface using fasteners (e.g., first set of fasteners 521).

Installation includes connecting the shroud base to the extended flange. Fasteners disposed through the outer bolt holes couple the shroud base to the extended flange. The extended flange is also configured with a set of outer bolt holes (e.g., outer holes 506) on an outer bolt circle (e.g., outer bolt circle 507). The outer bolt holes are configured to connect the extended flange to an inverted shroud base (e.g., a shroud base 544) using fasteners (e.g., a second set of fasteners 528) and a set of shroud base bolt holes (e.g. a set of base bolt holes 503).

The fasteners disposed through the outer bolt holes may couple the shroud base to the extended flange. The base bolt holes may correspond to and cooperate with the outer bolt holes on the extended flange. The shroud base may couple to the extended flange using the second set of fasteners, the base bolt holes on the shroud base, and the outer holes on the extended flange.

Installation of the inverted shroud may occur after the downhole gauge (e.g., sensor 526), motor (e.g., motor 516), and protector (e.g., protector 520) have been connected. Installation includes placing the intake (e.g., intake 524) over the protector and bolting the extended flange onto the protector via the inner bolt holes. Fasteners disposed through the inner bolt holes couple the extended flange of the intake base to the top of the protector.

Installation includes connecting the inverted shroud to the shroud base, and/or the inverted shroud directly to the extended flange. In accordance with one or more embodiments coupling techniques are disclosed including the use of fasteners, friction, hook and groove, and threads.

Fasteners with extended flange. An inverted shroud downhole end may have a set of bolt holes (e.g., shroud bolt holes). The shroud bolt holes may correspond to and cooperate with a set of bolt holes (e.g., the outer holes) on the extended flange or the shroud bolt holes may correspond to and cooperate with a set of base shroud holes. The inverted shroud may couple to the shroud base using a set of fasteners, the shroud bolt holes, and the base shroud holes. The inverted shroud may couple directly to the extended flange using a set of fasteners, the shroud bolt holes on the inverted shroud downhole end, and the outer holes on the extended flange.

Friction with extended flange. Friction elements or a single friction element disposed in the inverted shroud may couple the shroud to the shroud base and/or to the extended flange. An inverted shroud downhole end may have an exterior profile with a friction element such as an o-ring (e.g., a friction element) and a friction element groove such as an o-ring groove (e.g., a groove). The groove is configured for the o-ring. The friction element may correspond to and cooperate with an interior profile with a friction element preparation on the shroud base. The inverted shroud may couple to the shroud base using the exterior profile, the friction element, the groove, the interior profile, and the friction element preparation. The friction element may correspond to and cooperate with an interior profile with a friction element preparation on the extended flange. The inverted shroud may couple directly to the extended flange using the exterior profile, the friction element, the groove, the interior profile, and the friction element preparation.

Hook and groove with extended flange. A J-hook disposed in the inverted shroud may couple the shroud to the shroud base and/or to the extended flange. An inverted shroud downhole end may have an exterior profile with a J-hook element (e.g., a hook). The hook may correspond to and cooperate with an interior profile with a J-slot-and-groove, i.e., a slot element (e.g., a slot) on the shroud base. The inverted shroud may couple to the shroud base using the exterior profile, the J-hook element, the interior profile, and the slot element. The hook may correspond to and cooperate with an interior profile with a J-slot-and-groove, i.e., a slot element (e.g., a slot) on the extended flange. The inverted shroud may couple directly to the extended flange using the exterior profile, the J-hook element, the interior profile, and the slot element.

Threads with extended flange. A thread disposed in the inverted shroud may couple the shroud to the integrated flange. An inverted shroud downhole end may have an exterior profile with a first thread element such as a male thread (e.g., a pin). The pin may correspond to and cooperate with an interior profile comprising a second thread element such as a female thread (e.g., a box) on the shroud base. The inverted shroud may couple to the shroud base using the exterior profile, the first thread, the interior profile, and the second thread element. The pin may correspond to and cooperate with an interior profile comprising a second thread element such as a female thread (e.g., a box) on the extended flange. The inverted shroud may couple to the extended flange using the exterior profile, the first thread element, the interior profile, and the second thread element.

The inverted shroud system may include sealing (e.g., seal 550) to prevent passage of liquids and/or gases across the inverted shroud components. Sealing may be provided between the shroud base and the top surface of the extended flange. For example, a gasket (e.g., seal 550) may be placed between the shroud base and the extended flange with the fasteners through the outer bolt holes coupling the gasket between the shroud base and the extended flange. This forms a shroud-extended flange seal between the inverted shroud and the intake. In another embodiment, the extended flange and/or shroud base connection profiles may include a groove (e.g., o-ring groove 551) configured for use with an O-ring (e.g. seal 550) to provide sealing.

Integrated Flange System

The system (e.g., integrated flange system 600) in FIG. 6 shows use of an integrated shroud base flange (e.g., integrated shroud base 602) to couple the inverted shroud module (e.g., inverted shroud 642). FIG. 6*a* shows an enlarged view of a portion of FIG. 6. FIG. 6 shows the shroud base integrated into the intake flange of the intake-protector interface to form an integrated shroud-intake base. The intake flange has been configured to couple to the inverted shroud using the integrated shroud base.

The integrated shroud base 602 is configured with a set of inner bolt holes (e.g., inner holes 604) on an inner bolt circle (e.g., inner bolt circle 605). The inner bolt holes are configured to connect the intake to the protector forming the intake-protector interface using fasteners (e.g., first set of fasteners 621).

Installation of the integrated shroud may occur after the downhole gauge (e.g., sensor 626), motor (e.g., motor 616), and protector (e.g., protector 620) have been connected. Installation includes placing the intake (e.g., intake 624) over the protector and bolting the integrated flange onto the protector via the inner bolt holes. Fasteners disposed through the inner bolt holes couple the integrated flange of the intake base to the top of the protector.

Installation includes connecting the shroud to the integrated flange. In accordance with one or more embodiments coupling techniques are disclosed including the use of fasteners, friction, hook and groove, and threads.

Fasteners with integrated flange. Fasteners disposed through the outer bolt holes may couple the shroud to the integrated flange. An inverted shroud downhole end may have a first set of bolt holes (e.g., shroud bolt holes). The shroud bolt holes may correspond to and cooperate with a second set of bolt holes (e.g., a base shroud holes) on the integrated shroud base flange. The inverted shroud may couple to the integrated shroud base using a set of fasteners, the first set of bolt holes (shroud bolt holes) on the inverted shroud downhole end, and the second set of bolt holes (base shroud holes) on the integrated shroud base flange.

Friction with integrated flange. Friction elements or a single friction element disposed in the inverted shroud may couple the shroud to the integrated flange. An inverted shroud downhole end may have a friction element such as an o-ring (e.g., a friction element) and a friction element groove such as an o-ring groove (e.g., a groove). The groove is configured for use with the o-ring. The friction element may correspond to and cooperate with a friction element preparation on the integrated shroud base flange. The inverted shroud may couple to the integrated shroud base using the friction element, the groove, and the friction element preparation.

Hook and groove with integrated flange. A J-hook disposed in the inverted shroud may couple the shroud to the integrated flange. An inverted shroud downhole end may have an exterior profile with a J-hook element (e.g., a hook). The hook may correspond to and cooperate with an interior profile comprising a J-slot-and-groove, i.e., a slot element (e.g., a slot) on the integrated shroud base flange. The inverted shroud may couple to the integrated shroud base using the exterior profile, the J-hook element, the interior profile, and the slot element.

Threads with integrated flange. A thread disposed in the inverted shroud may couple the shroud to the integrated flange. An inverted shroud downhole end may have an exterior profile with a first thread element such as a male thread (e.g., a pin). The pin may correspond to and cooperate with an interior profile comprising a second thread element such as a female thread (e.g., a box) on the integrated shroud base flange. The inverted shroud may couple to the integrated shroud base using the exterior profile, the first thread, the interior profile, and the second thread element.

The inverted shroud system may include sealing (e.g., a seal 650) to prevent passage of liquids and/or gases across the components of the integrated flange to the shroud interface. Sealing may be provided between the shroud and the integrated base flange. For example, a gasket (e.g., the seal 650) may be placed between the shroud and the integrated flange with the fasteners through the outer bolt holes coupling the gasket between the shroud base and the integrated flange. This forms a shroud-integrated base seal between the inverted shroud and the intake. In another embodiment, the integrated flange and/or shroud base connection profiles may include a groove (e.g., o-ring groove 651) configured for use with an O-ring (e.g., the seal 650) to provide sealing.

A fastener access gap (e.g., a gap 652) is formed above the top surface of the intake base flange. The gap may be, for example, between the top surface of the intake base flange and a bottom surface of a downhole end of an intake body. A design parameter for the intake is that the gap is configured to allow bolts and/or studs (e.g., stud 654) to be disposed in the gap. A design parameter of the bolts and/or studs is that they are of sufficient length (e.g., customary length or longer than is customary) to couple the intake base flange to the protector top flange. Therefore, the gap is configured to provide access to the longer bolts to be used in the assembly.

Inverted Shroud Module Systems

With regards to the inverted shroud, it may be a challenge to handle a very long single length inverted cylinder during field installation. In accordance with one or more embodiments, the shroud length is divided into a set of housing sections. Each housing section may have a length of, for example, ten feet. The housing sections can be any length other than ten feet. Each housing section can be connected to an adjoining section to assemble the inverted shroud.

Friction Modules

Figure 7B:
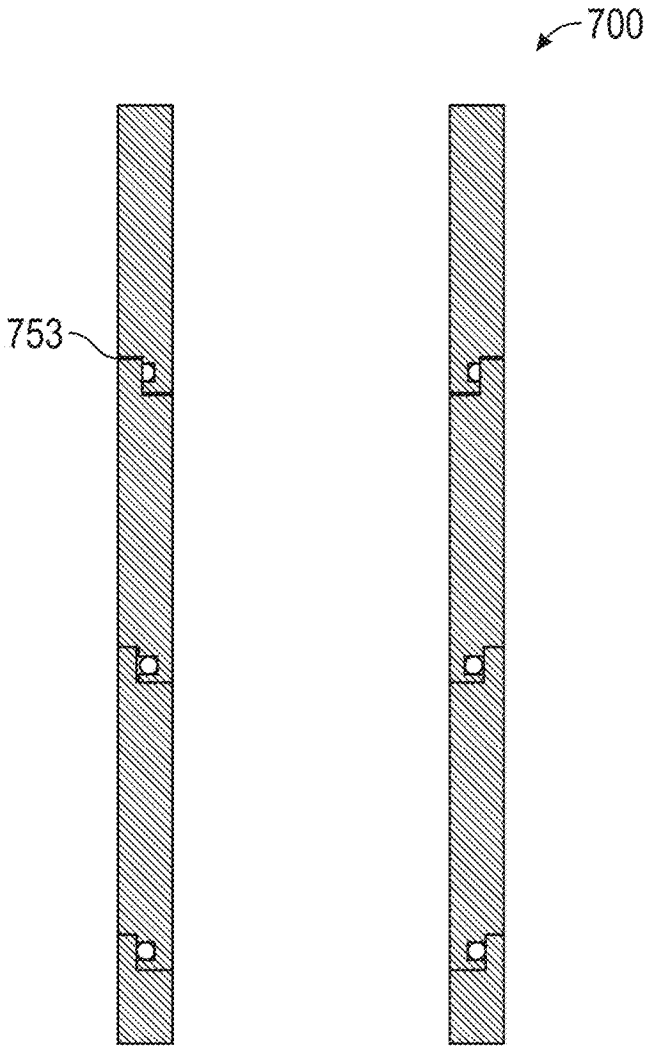
FIGS. 7A-7B show use of friction to couple adjoining inverted shroud modules in accordance with one or more embodiments.
Figure 7A:
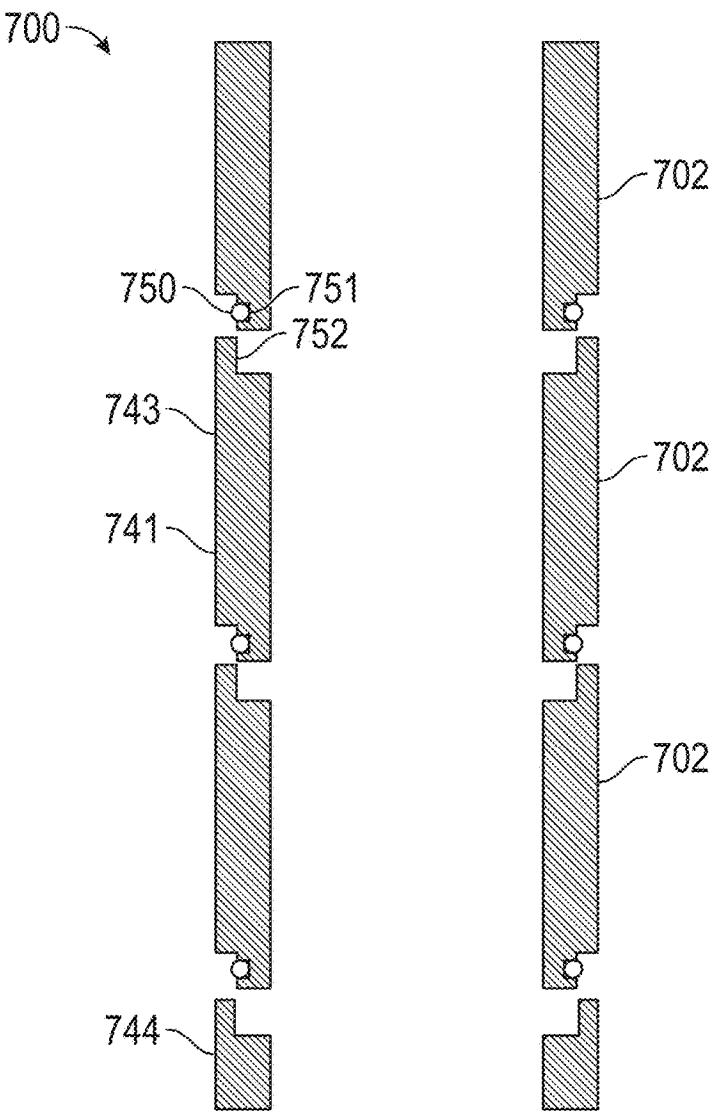

The system (e.g., friction module system 700) in FIG. 7A and FIG. 7B shows use of friction to couple adjoining inverted shroud modular housing/sections, hereafter friction modules (e.g., friction module 702) and friction O-rings (e.g., a friction element 750). In this architecture, the bottom contacting surface of each modular section (e.g., friction module downhole end 741) is configured with an exterior profile comprising an o-ring groove (e.g., groove 751) and is fitted with one of the friction O-rings. Each top contacting surface (e.g., friction module uphole end 743) is configured with an interior profile comprising a friction o-ring contact surface (e.g., friction element preparation 752). Although O-rings are typically used as seals to prevent fluid ingress at a given location, such as ingress from liquids and/or gases, in this embodiment, the friction O-rings aid in increasing the frictional contact force between adjoining friction modules during assembly. In accordance with one or more embodiments, the friction element preparation 752, the friction element 750, and the groove 751 cooperate to form an assembly of two friction modules comprising a sufficient level of friction to hold the modules together for the purpose of installation and use.

To assemble the friction modules, two adjoining friction modules, an upper friction module and a lower friction module, are stacked on top of one another during equipment installation at the wellsite. The upper friction module is coupled to the lower friction module using the o-ring and the friction o-ring contact surface thereby forming a friction module interface (e.g., friction module interface 753). The friction modules may be configured to couple to a shroud base (e.g., shroud base 744). For example, the module downhole end may couple to the shroud base at a shroud base friction end of the inverted shroud base.

A seal may be disposed between the friction module downhole end and shroud base friction end and/or the inverted shroud friction end to form a shroud module first seal between the friction module and the inverted shroud. A seal, in addition to the o-ring, may be disposed between the upper friction module downhole end and the lower friction module uphole end thereby forming a shroud module second seal. In this manner, the seals may form a seal between the inverted shroud and the intake.

Friction modules may be used together with other inverted shrouds. Coupling the inverted shroud to the ESP may include coupling a friction module downhole end 741 of a first friction module to a shroud friction element in an inverted shroud friction end. The first friction module may have the module friction element disposed in the first friction module downhole end. A second friction module (e.g., the upper friction module) may couple to the first friction module (e.g., the lower friction module). Coupling the inverted shroud to the ESP may include coupling a second friction module downhole end of the second friction module to a first friction element disposed in a first friction module uphole end. The second friction module may have the second friction element disposed in the second friction module downhole end.

Slot Modules

Figure 8B:
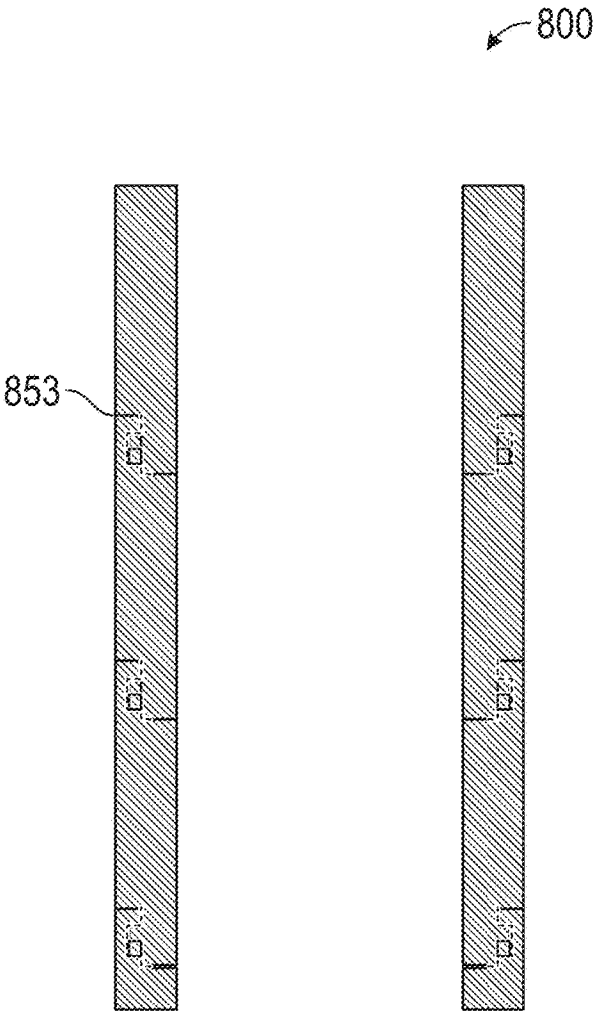
FIGS. 8A-8B show use of hook and slot to couple adjoining inverted shroud modules in accordance with one or more embodiments.
Figure 8A:
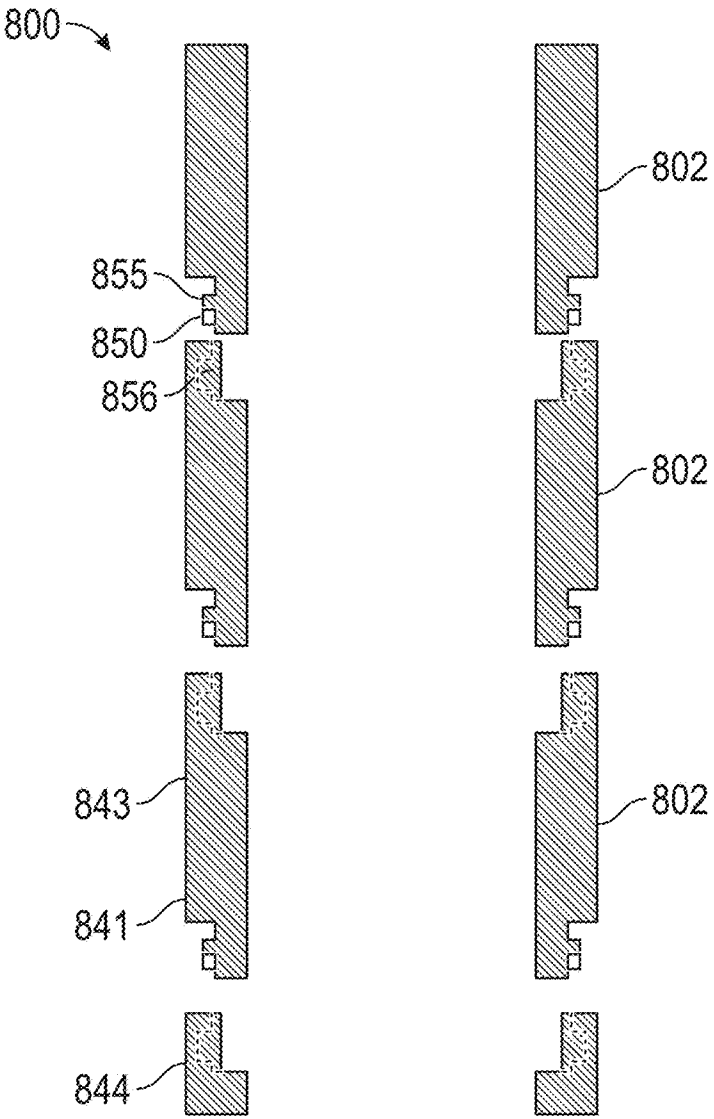

The system (e.g., slot module system 800) in FIG. 8A and FIG. 8B show use of a J-hook and J-slot-and-groove to couple adjoining inverted shroud modular housing/sections, hereafter slot modules (e.g., slot module 802). In this architecture, the bottom contacting surface (e.g., slot module downhole end 841) is configured with an exterior profile comprising a J-hook element (e.g., hook 855). Each top contacting surface (e.g., slot module uphole end 843) is configured with an interior profile comprising a J-slot-and-groove, i.e., a slot element (e.g., a slot 856).

To assemble the slot modules, two adjoining slot modules, an upper slot module and a lower slot module, are stacked on top of one another during equipment installation at the wellsite. The upper slot module is coupled to the lower slot module using the J-hook and the slot thereby forming a slot module interface (e.g., slot module interface 853). The coupling method includes engaging the J-hook of the upper slot module into the slot of the lower slot module. The method continues by rotating the upper slot module and/or the lower slot module relative to each other thereby engaging the upper module's J-hook with the lower module's slot.

The slot modules may be configured to couple to the shroud base (e.g., shroud base 844). The first hook element of the first slot module downhole end is coupled to a shroud slot element in a shroud base slot end. For example, the module downhole end may couple to the shroud base at a shroud base slot end of the inverted shroud base.

A seal may be disposed between the slot module downhole end (e.g., a hook end) and the shroud base slot end and/or the inverted shroud slot end to form a shroud module first seal between the slot module and the inverted shroud. A seal may be disposed between the upper slot module downhole end and the lower slot module uphole end thereby forming a shroud module second seal. In this manner the seals may form a seal between the inverted shroud and the intake.

Slot modules may be used together with other inverted shrouds. Coupling the inverted shroud to the ESP may include coupling the slot module downhole end 841 of a first slot module to a shroud slot element in an inverted shroud slot end. The first slot module may have the module slot element disposed in the first slot module downhole end. A second slot module (e.g., the upper slot module) may couple to the first slot module (e.g., the lower slot module). Coupling the inverted shroud to the ESP may include coupling a second slot module downhole end of the second slot module to a first slot element disposed in a first slot module uphole end. The second slot module may have the second slot element disposed in the second slot module downhole end.

FIG. 8A and FIG. 8B show that the system (slot module system 800) may include sealing (e.g., seal 850) provided at the slot module interface 853. One or more of a gasket may be disposed at the slot module downhole end and/or at the slot module uphole end. The gasket may seal at the slot module interface. For example, FIG. 8A and FIG. 8B show a slot module gasket in the assembly for use as a seal.

Note that the contact forces are such that they can hold the sections together during assembly and, in use, and can also be easily disassembled. In accordance with one or more embodiments, the well fluid preferentially flows on the outside of the inverted shroud to the top, makes a U-turn and flows down towards the intake.

Threaded Modules

Figure 9B:
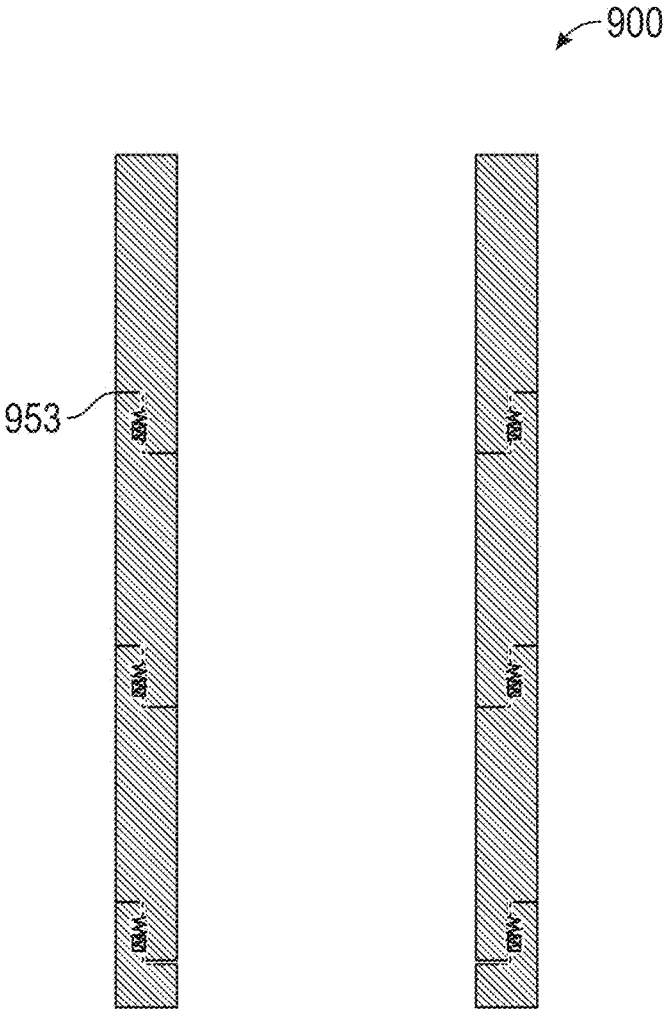
FIGS. 9A-9B show use of threads to couple adjoining inverted shroud modules in accordance with one or more embodiments.
Figure 9A:
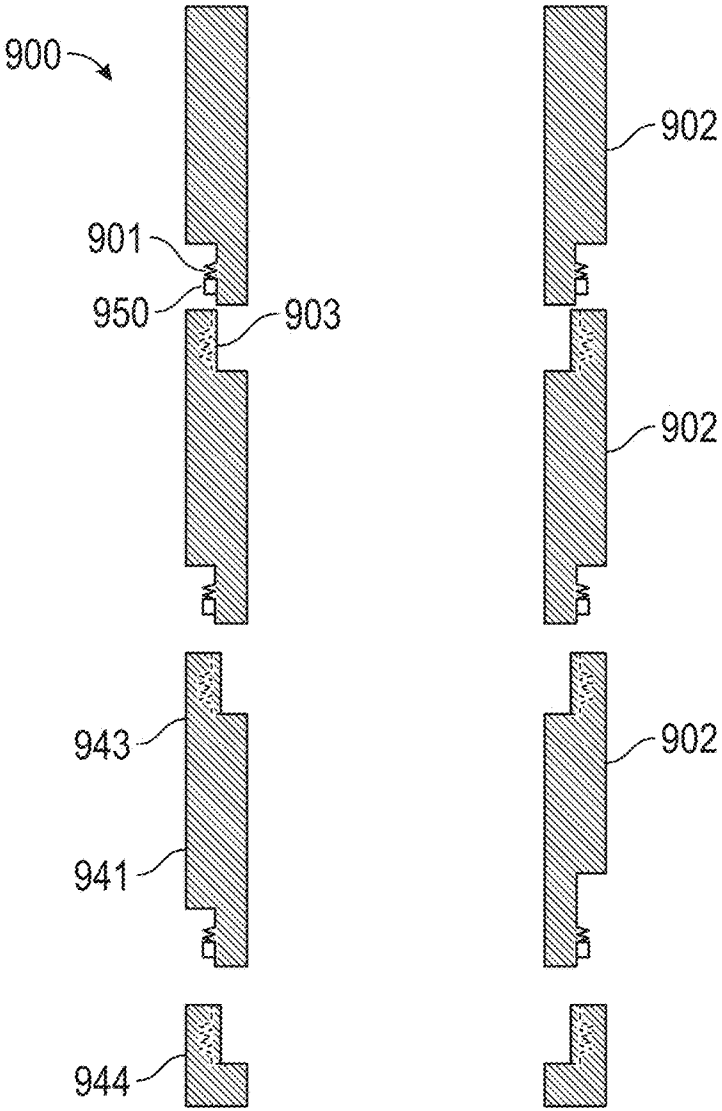

The system (e.g., threaded module system 900) in FIG. 9A and FIG. 9B show use of a first thread (e.g., a module threaded element) such as a male thread (e.g., pin 901) and a second thread (e.g., a second threaded element) such as a female thread (e.g., box 903) to couple adjoining inverted shroud modular housing/sections, hereafter threaded modules (e.g., threaded module 902). In this architecture, the bottom of each modular section (e.g., threaded module downhole end 941) is configured with a module threaded element. For example, the bottom of the threaded module, i.e., the downhole end, may have a thread such as a pipe, tubing, or casing thread (e.g., pin 901). The top of each module section (e.g., threaded module uphole end 943) is configured with a module threaded element. For example, the top of the threaded module, i.e., the uphole end, may have a thread corresponding with the pin 901. The uphole end may have, for example, a female thread (e.g., box 903). The pin 901 and the box 903 may be configured to cooperate to form a threaded connection or threaded joint (e.g., a threaded module interface 953).

The threaded connections between adjoining threaded modules may follow customary oilfield practice for production tubing and/or casing connections. For example, a first thread module of a pair of adjoining threaded modules may have an external thread (e.g., pin 901) and a second thread module of the pair may have an internal thread (e.g., box 903). Both threaded modules can be threaded together on the rig floor using torquing tongs during assembly of the ESP. The threaded module may be bolted to or could thread directly onto the extended flange and/or the integrated flange. The threaded module may thread to the split flanges using specialized manufacturing of the split flanges such as the manufacturing technique used for manufacturing casing slips used in casing hangers and tubing slips used in tubing hangers.

To assemble the threaded modules, two adjoining threaded modules, an upper threaded module and a lower threaded module, are stacked on top of one another during equipment installation at the wellsite. The upper threaded module is coupled to the lower threaded module. The upper threaded module is coupled to the lower threaded module using the external threads and the internal threads respectively, thereby forming the threaded module interface 953. The threaded module may be configured to couple to a shroud base (e.g., shroud base 944). For example, the module downhole end may couple to the shroud base at a shroud base threaded end of the inverted shroud base.

Threaded modules may be used together with other inverted shrouds. Coupling the inverted shroud to the ESP may include coupling the threaded module downhole end 941 of a first threaded module to a shroud threaded element in an inverted shroud threaded end. The first threaded module may have the module threaded element disposed in the first threaded module downhole end. A second threaded module (e.g., the upper threaded module) may couple to the first threaded module (e.g., the lower threaded module). Coupling the inverted shroud to the ESP may include coupling a second threaded module downhole end of the second threaded module to a first threaded element disposed in a first threaded module uphole end. The second threaded module may have the second threaded element disposed in the second threaded module downhole end.

FIG. 9A and FIG. 9B show that the system (e.g., threaded module system 900) may include sealing using a threaded seal (e.g., seal 950) provided at the threaded module interface and/or between a thread module and the shroud base threaded end. For example, coupling the first threaded module downhole end to the shroud base threaded end may form a first threaded seal between the first threaded module and the intake. The threaded modules may be configured with sealing threads as customary for oil country tubular goods (OCTG). The sealing threads may follow OCTG industry standards such as those from the American Petroleum Institute (API), e.g., API 5CT. The threaded joint may include a coupling such as a reducing coupling or a seal ring coupling. The thread form may follow API standards.

The pin 901 and the box 903 may not have compatible threads and therefore a combination coupling may be used to form the threaded module interface 953. For example, a combination coupling may be used to adapt a pin thread of a first thread form to a box thread of a second thread form. Likewise for differing sizes of threads, an adapter such as the reducer coupling may be used. In each case, the threaded module interface may include a threaded seal.

The threaded module downhole end 941 and the threaded module uphole end 943 may each have a pin thread. In that case, a coupling may be used. In like manner, the threaded module downhole end 941 and the threaded module uphole end 943 may each have a box thread. In that case a nipple may be used to form the threaded module interface.

Upon assembly the threaded connection formed by sealing threads provides sealing at the threaded module interface. The threaded modules may be configured for use with one or more of a gasket such as a gasket disposed at the threaded module downhole end and/or at the threaded module uphole end. The gasket may seal at the threaded module interface. The threaded modules may be configured with one or more gaskets in addition to sealing threads.

Assembled Systems

Figures 10A, 10B, 10C:
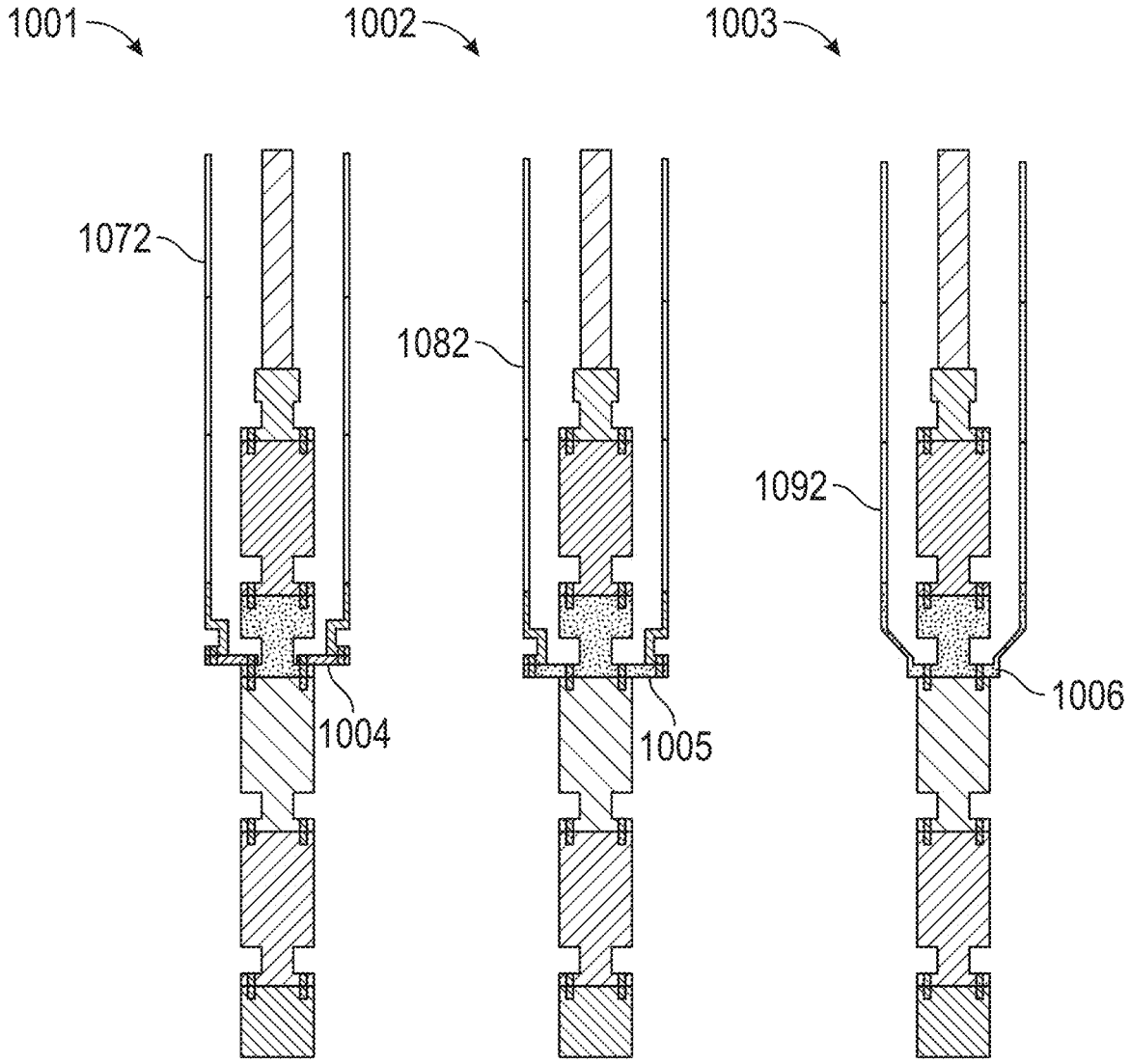
FIG. 10A shows the use of shroud base flanges in accordance with one or more embodiments.
FIG. 10B shows the use of an extended intake base flange in accordance with one or more embodiments.
FIG. 10C shows the use of an integrated shroud-intake base in accordance with one or more embodiments.

FIG. 10A, FIG. 10B, and FIG. 10C show the assembled embodiments of the inverted shroud. FIG. 10A shows an embodiment 1001 using the shroud base flanges (e.g., shroud base flanges 1004), the shroud base, and quantity three of the inverted shroud housing sections (e.g., an inverted shroud section 1072). FIG. 10B shows an embodiment 1002 using the extended intake base flange (e.g., extended intake base flange 1005), the shroud base, and three housing sections (e.g., an inverted shroud section 1082). FIG. 10C shows an embodiment 1003 using the integrated shroud-intake base (e.g., integrated shroud base 1006) and three housing sections (e.g., an inverted shroud section 1092).

In each of the above embodiments, the installation method may include an alternating installation sequence wherein as each ESP component is installed, an inverted shroud housing section is installed before progressing to installing the next ESP component. The method is reversed during retrieval of the inverted shroud.

The embodiments disclosed within do not limit in any way the scope of this invention. It is possible that different combinations of the components, systems, and method highlighted in this disclosure can be implemented. For example, the system may include a combination of the shroud base flanges, extended intake base flange, and integrated shroud-intake base with any of the modular housing assembly methods, friction modules, slot modules, and/or threaded modules.

The shroud base flanges, the extended base flange, and/or the integrated base flange may be made with an incline instead of with the horizontal arrangement shown. The inclined feature may ensure no fluid dead zones (fluid in a stagnant condition) exist just below the intake assembly.

Standard centralizers may be used between the outer diameter of the inverted shroud and the internal diameter of the casing. The centralizers ensure the inverted shroud does not contact an internal diameter of the casing during installation downhole. Furthermore, use of centralizers may avoid erosion issues. The use of centralizers promotes concentricity of the ESP, shroud, and casing ID. Centralizers may ensure approximately equal radial clearances between the casing and the inverted shroud. Approximately equal radial clearances may promote a near-concentric flow area and fluid velocity during operation. Non-concentric radial clearances may increase fluid flow velocity. The high velocity from the non-concentric radial clearances may create erosion issues. In this manner the centralizers may avoid the erosion. Centralizers may be used between the outer diameter of the ESP assembly components and the internal diameter of the shroud. The centralizers may provide the benefits described previously.

Power Cable/Motor Lead Extension (MLE) attachments may be used. The cable supplying power to the motor needs to go past the inverted shroud assembly to the motor further downhole. This cable needs to be held in place to ensure a sturdy assembly. Cable bands are typically used in ESP installations to attach cables to production tubing and/or the ESP assembly. For the inverted shroud application, if the cable is to go along the outer diameter of the shroud, a cable band may be used. Alternatively, a cable clamp may be used. To reduce the size of the cable clamp due to additional diameter from the cable thickness, a cable groove and/or cable slot may be machined on the outer diameter of the inverted shroud so the cable may be recessed within the cable groove and/or cable slot.

If the power cable is to go through the internal section of the inverted shroud, then the cable can be affixed to the production tubing and the ESP assembly components using the standard cable bands. However, a through-access is incorporated at one or more of the lower housing section of the inverted shroud, the shroud base, or the shroud base flanges. Design parameters for the preferred option is based on space availability, which can be ascertained during the engineering design for the specific field application.

Figure 11:
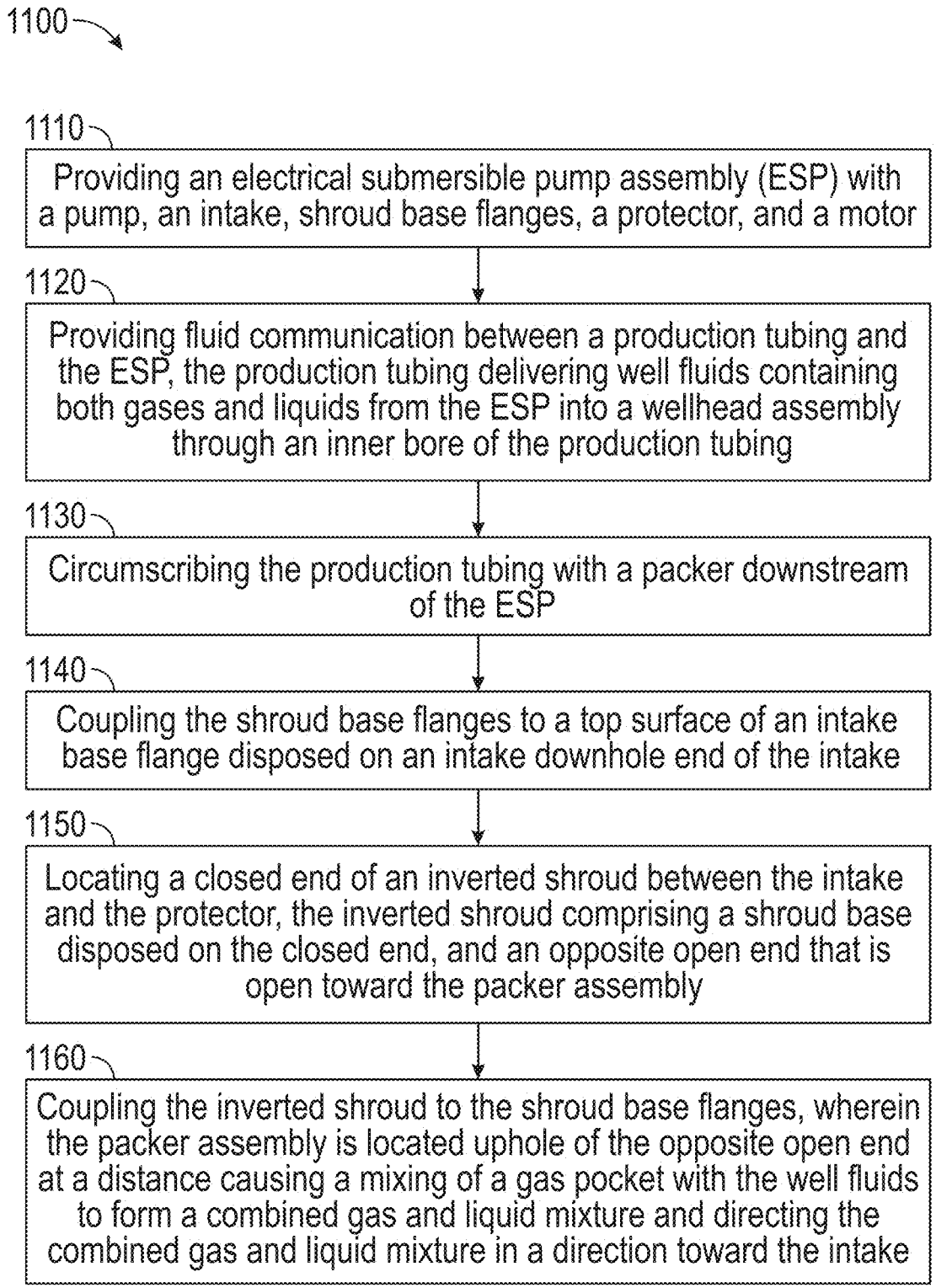
FIG. 11 shows a flowchart in accordance with one or more embodiments.

Turning to FIG. 11, FIG. 11 shows a flowchart (e.g., a method 1100) in accordance with one or more embodiments. Specifically, FIG. 11 describes a general method using a tubing-deployed ESP with an inverted shroud to flow fluids in various pipe components in a wellbore. One or more blocks in FIG. 11 may be performed by one or more components, e.g., as described in FIGS. 1, 2, 3, 4A, 4B, 4C, 5, 6, 7A, 7B, 8A, 8B, 9A, 9B, 10A, 10B, and 10C. While various blocks in FIG. 11 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 1110, an electrical submersible pump assembly (ESP) with a pump, an intake, shroud base flanges, a protector, and a motor is provided.

In Block 1120, fluid communication is provided between a production tubing and the ESP. The production tubing delivers well fluid containing both gases and liquids from the ESP into a wellhead assembly through an inner bore of the production tubing.

At step 1130, a packer is located downstream of the ESP and circumscribes the production tubing.

At step 1140, shroud base flanges are coupled to a top surface of an intake base flange. The intake base flange is on an intake downhole end of the intake. The shroud base flanges are coupled using a first set of fasteners, a set of inner bolt holes disposed on the shroud base flanges, and a set of protector top bolt holes disposed on a protector top surface of a protector top flange of the protector.

At step 1150, a closed end of an inverted shroud is located between the intake and the protector. The inverted shroud has a shroud base disposed on the closed end. The inverted shroud has an opposite open end that is open toward the packer assembly.

At step 1160, the inverted shroud is coupled to the shroud base flanges using a second set of fasteners, a set of outer bolt holes disposed on the shroud base flanges, and a set of shroud base bolt holes disposed on the shroud base. The packer assembly is located uphole of the opposite open end at a distance causing a mixing of a gas pocket with the well fluids to form a combined gas and liquid mixture, and directing the combined gas and liquid mixture in a direction toward the intake.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method comprising:

providing an electrical submersible pump assembly (ESP) with a pump, an intake, shroud base flanges, a protector, and a motor;

providing fluid communication between a production tubing and the ESP, the production tubing delivering well fluid containing both gases and liquids from the ESP into a wellhead assembly through an inner bore of the production tubing;

circumscribing the production tubing with a packer assembly downstream of the ESP;

coupling the shroud base flanges to a top surface of an intake base flange disposed on an intake downhole end of the intake, using a first set of fasteners, a set of inner bolt holes disposed on the shroud base flanges, and a set of protector top bolt holes disposed on a protector top surface of a protector top flange of the protector;

locating a closed end of an inverted shroud between the intake and the protector, the inverted shroud comprising:

a shroud base disposed on the closed end, and an opposite open end that is open toward the packer assembly; and coupling the inverted shroud to the shroud base flanges using a second set of fasteners, a set of outer bolt holes disposed on the shroud base flanges, and a set of shroud base bolt holes disposed on the shroud base;

wherein the packer assembly is located uphole of the opposite open end at a distance causing a mixing of a gas pocket with the well fluid to form a combined gas and liquid mixture and directing the combined gas and liquid mixture in a direction toward the intake.

2. The method of claim 1, wherein locating the closed end of the inverted shroud further comprises coupling a first friction module downhole end of a first friction module comprising a first friction element disposed in the first friction module downhole end to an inverted shroud friction end.

3. The method of claim 2, wherein locating the closed end of the inverted shroud further comprises coupling a second friction module downhole end of a second friction module comprising a second friction element disposed in the second friction module downhole end to a first friction module uphole end.

4. The method of claim 3, wherein coupling the second friction module downhole end to the first friction module uphole end further comprises coupling a fourth sealing element disposed between the second friction module downhole end and the first friction module uphole end to form a shroud module second seal between the second friction module and the first friction module.

5. The method of claim 2, wherein coupling the first friction module downhole end to the inverted shroud friction end further comprises coupling a third sealing element disposed between the first friction module downhole end and the inverted shroud friction end to form a shroud module first seal between the first friction module and the inverted shroud.

6. The method of claim 1, wherein coupling the shroud base flanges to the top surface further comprises coupling a first sealing element disposed between the shroud base flanges and the top surface to form a shroud base-top surface seal between the inverted shroud and the intake.

7. The method of claim 1, wherein coupling the inverted shroud to the shroud base flanges further comprises coupling a second sealing element disposed between the inverted shroud and the shroud base flanges to form a shroud-flange seal between the inverted shroud and the intake.

8. A system, comprising:

an electrical submersible pump assembly (ESP) with a pump, an intake, shroud base flanges, a protector, and a motor;

production tubing in fluid communication with the ESP and comprising an inner bore sized to deliver well fluid containing both gases and liquids from the ESP to a wellhead assembly;

a packer assembly circumscribing the production tubing downstream of the ESP;

a first set of fasteners, a set of inner bolt holes disposed on the shroud base flanges, and a set of protector top bolt holes disposed on a protector top surface of a protector top flange of the protector, wherein the first set of fasteners is configured to couple the shroud base flanges to a top surface of an intake base flange disposed on an intake downhole end of the intake;

an inverted shroud comprising:

a closed end configured to be located between the intake and the protector;

an opposite open end that is open towards the packer assembly; and a shroud base disposed on the closed end; and a second set of fasteners configured to couple the inverted shroud to the shroud base flanges using a set of outer bolt holes disposed on the shroud base flanges, and a set of base bolt holes disposed on the shroud base;

wherein the packer assembly is located uphole of the opposite open end at a distance operable to cause a mixing of a gas pocket with the well fluid to form a combined gas and liquid mixture and to direct the combined gas and liquid mixture in a direction towards the intake.

9. The system of claim 8, wherein the inverted shroud further comprises:

a first friction module comprising a first friction element disposed in a first friction module downhole end configured to couple to an inverted shroud friction end, and a second friction module comprising a second friction element disposed in a second friction module downhole end configured to couple to a first friction module uphole end.

10. The system of claim 9, further comprising:

a first sealing element disposed between the shroud base flanges and the top surface to form a shroud base-top surface seal between the inverted shroud and the intake;

a second sealing element disposed between the inverted shroud and the shroud base flanges to form a shroud-flange seal between the inverted shroud and the intake;

a third sealing element disposed between the first friction module downhole end and the inverted shroud friction end to form a shroud module first seal between the first friction module and the inverted shroud; and a fourth sealing element disposed between the second friction module downhole end and the first friction module uphole end to form a shroud module second seal between the second friction module and the first friction module.

* * * * *